US005887391A

United States Patent [19]

Shoup

[11] Patent Number: 5,887,391

[45] Date of Patent: Mar. 30, 1999

[54] STORM DOOR AND METHOD OF FABRICATION THEREOF

[75] Inventor: Curtis C. Shoup, Gardena, Calif.

[73] Assignee: Columbia Manufacturing Co., Gardena, Calif.

[21] Appl. No.: 17,231

[22] Filed: Feb. 2, 1998

[51] Int. Cl.[6] ..... E06B 1/04

[52] U.S. Cl. ..... 52/202; 52/204.51; 52/204.7; 52/656.7

[58] Field of Search ..... 52/202, 656.7, 52/656.4, 204.51, 207, 455, 204.6, 204.67, 204.68, 204.7, 204.71; 49/440, 504, DIG. 2, 161, 163

[56] References Cited

U.S. PATENT DOCUMENTS

| | | | |
|---|---|---|---|
| 2,597,539 | 5/1952 | Smart | 52/204.51 |
| 2,760,607 | 8/1956 | Bongiovanni | 52/204.51 |
| 2,869,187 | 1/1959 | Liebman et al. | 52/204.51 |
| 2,916,112 | 12/1959 | Kiehl | 52/656.7 |
| 3,024,837 | 1/1962 | McPhail | 160/91 |
| 3,243,928 | 4/1966 | Hare | 52/202 |
| 3,430,385 | 3/1969 | Biro | 52/656.7 |
| 3,992,815 | 11/1976 | Potter | 52/202 |
| 4,599,836 | 7/1986 | Melcher | 52/202 |
| 4,674,246 | 6/1987 | Giguere | 52/204.51 |
| 4,702,050 | 10/1987 | Giguere | 52/202 |
| 5,012,616 | 5/1991 | Martin | 49/501 |
| 5,603,585 | 2/1997 | Bruchu | 52/656.4 |

FOREIGN PATENT DOCUMENTS

| | | | |
|---|---|---|---|
| 2150187 | 6/1985 | United Kingdom | 52/204.51 |
| 2150188 | 6/1985 | United Kingdom | 52/204.51 |

*Primary Examiner*—Carl D. Friedman
*Assistant Examiner*—Phi Dieu Tran A
*Attorney, Agent, or Firm*—Charles H. Thomas

[57] ABSTRACT

A unique storm door construction utilizes economical, plastic glide channel strips disposed about fixed and sliding panes of glass to provide not only a weather seal, but also a means for interconnection to a storm door mounting frame within which the glass panes are mounted. The system also provides a top edge protector for the sliding pane, as well as a sash member with a finger grip thereon that can be used to raise and lower the sliding pane. The sliding pane member can thereby be raised to permit ventilation through a screen covering a portion of the rectangular opening defined in the storm door frame. Alternatively, the sliding pane member can be lowered to thereby provide a complete, transparent, weather-tight barrier across the enclosed rectangular area delineated within the storm door frame. The system provides a means for assembly of a storm door which allows the component elements to be snapped together without the use of screws or other metal fasteners.

16 Claims, 12 Drawing Sheets

STORM DOOR AND METHOD OF FABRICATION THEREOF

BACKGROUND OF THE INVENTION

1. Field of the Invention

The present invention relates to a unique construction of a storm door for a building, and the method of manufacturing a storm door having this unique construction.

2. Description of the Prior Art

For many years storm doors have been produced and utilized to provide an extra measure of thermal and moisture insulation at door openings of a building. Some styles of storm doors are currently formed of one or more panes of glass seated within a surrounding metal door frame.

In the construction of storm doors it is important to avoid direct contact between the metal of the door frame and the glass of the panes held within the frame. The elimination of such metal to glass contact is sometimes achieved by interposing a rubber or plastic gasket between the metal door frame and the glass pane or panes. This is normally accomplished by first laying the panes of glass onto a surrounding, resiliently compressible, water impervious gasket, and then advancing the metal frame members toward the glass panes so that channels or grooves within the metal frame members capture the peripheral margins of the gaskets. The metal storm door frame members are then secured to each other, typically by means of screws, to form longitudinally extending stile members and transversely extending top and bottom rail members. These members are fastened to each other with the gasketed pane or panes of glass held therewithin.

Other styles of storm doors are formed with a fixed glass pane and a sliding glass pane. Each of the glass panes occupies approximately one-half of the length of the elongated opening defined within the frame of the storm door. The sliding glass pane can be moved into a position offset from the fixed glass pane so as to completely cover the opening within the door frame. Alternatively, the sliding glass pane can be moved longitudinally so as to completely overlie the fixed glass pane. This allows air circulation through the portion of the opening vacated by the sliding glass pane. Very typically this opening is covered with a screen offset from the plane of the sliding glass pane. The screen admits air for ventilation, but excludes insects and reduces the passage of solid, airborne material.

The use of a sliding glass pane in a storm door is advantageous in that the user is able to select the level of ventilation permitted by the storm door. Very typically the sliding glass pane will be withdrawn from the portion of the opening which it would otherwise cover during periods of warm weather, and moved back into position longitudinally offset from the fixed glass pane so that the door opening is completely covered during periods of cold weather. The sliding glass pane may be partially opened or closed as intermediate temperature conditions dictate.

In a conventional combination screen and sliding glass pane storm door, the fixed glass pane is mounted within its own frame, which includes a gasket of the type described to prevent direct contact between the glass and the surrounding metal frame. Similarly, the sliding glass pane is also mounted within a separate metal frame in which a rubber or plastic gasket is interposed between the rectangular pane of glass and the surrounding metal frame. The metal frame of the fixed glass pane is secured within the larger metal storm door frame. The metal frame holding the sliding glass pane is also mounted in the larger storm door frame so as to move along longitudinal tracks defined in the storm door frame in a plane offset from the plane of the fixed glass pane.

While storm doors of conventional construction do provide adequate thermal and moisture insulation, they are relatively time consuming and expensive to fabricate. The rubber or plastic gasket must first be wrapped about each glass pane so that the edges of the glass reside within corresponding channels formed in the gasket material.

The pairs of opposing rail and stile members are then moved toward each other at the opposing edges of the gasket material. Care must be exercised to ensure that the gasket material properly enters into corresponding channels formed to receive it in the rail and stile members. The rail and stile members must then be secured to each other by means of fasteners, such as metal screws, so as to ensure that the frame members surrounding the gasket do not separate at the corners at which they meet. The assembly of a conventional storm door therefore takes quite a number of minutes to complete, even in the environment of an assembly line. Due to the labor intensity required to manufacture metal frame storm doors, the expense of production is relative high.

SUMMARY OF THE INVENTION

The present invention provides a new and innovative construction design for a storm door that avoids the time consuming, labor intensive steps in storm door manufacture that have heretofore been required. According to the system of the present invention, a storm door having both a fixed glass pane and a sliding glass pane may be quickly and easily fabricated while still avoiding any metal to glass contact in a much shorter time than has been possible to fabricate a functionally comparable conventional storm door.

A key aspect to the unique construction employed according to the present invention is the use of plastic glide channel strips in place of a conventional gasket. The glide channel strips provide channels within which the panes of glass are mounted in either fixed or sliding arrangement. The rectangular panes of glass are mounted directly in the glide channel strips, thus avoiding any requirement for a separate metal frame to surround the panes of glass as in prior metal frame storm doors. Furthermore, the glide channel strips not only separate the glass panes from the surrounding metal frame, but also form channels within which a sliding pane of glass can move.

A further important feature of the invention is that the glide channel strips are provided with mounting elements that may be quickly, easily, and securely engaged to the metal frame that surrounds the glass panes. Indeed, in the assembly of a storm door according to the invention, the plastic glide channel strips are first pressed onto the appropriate edges of the glass panes, and the glide pane strips are then pressed about their peripheries onto a delineating wall of the frame spline channel of the metal storm door frame.

The mounting elements of the glide channel strips are preferably mounting arms that are provided with resiliently deflectable barbs that engage a bearing ledge formed on the delineating wall of the frame spline channel that delineates and surrounds the enclosed rectangular area encompassed by the metal storm door frame. Although the plastic glide channels, carrying the glass panes mounted therein, may be pressed onto the delineating wall of the metal storm door frame in a matter of seconds, they establish a firm and secure interconnection with the storm door frame.

In one broad aspect the present invention may be considered to be a storm door comprising: a rectangular metal door frame; plastic glide channel strips; a fixed, transparent, rectangular pane; a transverse push bar; a window screen; a sliding, transparent, rectangular pane; and a sash member. The rectangular metal door frame is formed with interior and exterior faces and has a pair of longitudinally extending stiles and top and bottom rails extending between and joining the stiles. The stiles and rails define an enclosed, rectangular area and a frame spline channel. The frame spline channel is formed with a delineating wall surrounding the enclosed, rectangular area.

The plastic glide channel strips are provided on each of the stiles and on at least one of the rails. The glide channel strips each have three, inwardly directed legs forming an exterior pane receiving channel and an adjacent, interior, pane receiving channel. Each glide channel strip also includes a mounting arm hooked over the delineating wall of the frame spline channel. The mounting arms are secured in the frame spline channel.

The fixed, transparent, rectangular pane has four edges and is disposed in the exterior pane receiving channels of the plastic glide channel strips. Three of the edges of the fixed, rectangular pane are seated between the stiles and one of the rails. Preferably one of these three edges of the fixed pane is an upper edge which is received in the exterior pane receiving channel of the top rail.

The transverse push bar has opposing upper and lower sides and also ends which are secured to the stiles. The push bar defines on one of its upper and lower sides a fixed pane receiving groove lying in coplanar relationship with the exterior, pane receiving channel in the glide channel strips. The fixed pane receiving groove receives an edge of the fixed, rectangular pane. On the other of its upper and lower sides the push bar defines a screen receiving groove.

The window screen is located within the metal door frame and has two longitudinal screen frame edges and two opposing, transverse screen frame edges. The longitudinal screen frame edges are seated between the metal frame stiles. One transverse screen frame edge is seated in the screen receiving groove of the push bar.

The sliding, transparent pane has opposing transverse edges and opposing longitudinal edges. The longitudinal edges of the sliding pane are disposed in the interior pane receiving channels of the glide channel strips. The sash member is secured to one of the transverse edges of the sliding pane and has an interiorly projecting finger grip thereon.

Preferably the storm door of the invention is further comprised of a kick plate that is secured to the frame spline channel at the stiles and to the frame spline channel at the bottom rail. The upper edge of the kick plate forms a transversely extending lip. A plastic pane support for the sliding pane is attached to the lip of the kick plate. The sash member is thereby moveable into abutting contact against the pane support for the sliding pane. Preferably also, a plastic channel-shaped edge protector is secured to the other of the transverse edges of the sliding pane, opposite the edge to which the sash member is attached.

In the preferred arrangement the pane receiving channels of the glide channel strips and the channel-shaped edge protector are each formed with opposing, mutually facing, raised ribs. These ribs extend the lengths of the pane receiving channels and the length of the edge protector. The ribs contact the transparent, fixed and sliding panes.

An important feature of the invention is the ease and security of attachment of the plastic glide channel strips to the metal door frame. In the preferred arrangement, the metal frame spline channel has a channel floor from which the delineating wall rises. The delineating wall is created with a bearing ledge facing the frame spline channel floor. In the preferred construction, this bearing ledge is formed as a result of roll forming the spline and rail members of the door from a single, elongated metal strip in such a manner that the edges of the strip are brought together to form the frame spline channel. One of the edges is rolled over the other to form the bearing ledge.

The mounting arms of the plastic glide channel strips are formed with barbs that are forced into locking engagement with the bearing ledge when the mounting arms are hooked over the delineating wall. The mounting arms are resilient enough so that their ends flex to pass over the top of the delineating wall. The barbs at the ends of the mounting arms snap into position beneath the bearing ledge once the mounting arms have been pressed into the frame spline channel sufficiently for the barbs to clear the bearing ledge. The plastic glide channel strips are thereby easily, but firmly engaged with the metal door frame members.

The transverse push bar also employs another preferred feature of construction. Specifically, the ends of the transverse push bar are configured to form sockets. Coupling elements are employed and are located at the ends of the transverse push bar. The coupling elements are received in the sockets of the push bar and are formed with retaining elements. These retaining elements are pressed into the frame spline channels and are resiliently compressed between the metal frame stiles and the mounting arms of the plastic glide channel strips that are secured to the stiles.

In another broad aspect, the invention may be considered to be a method of fabricating a storm door. The method of the invention is comprised of the steps of: securing plastic glide channel strips to a fixed, transparent, rectangular pane; inserting the bottom edge of the fixed pane into an upper, transverse groove of a transverse push bar; inserting a plastic sash member onto the bottom, transverse edge of a sliding, transparent pane; inserting the longitudinal edges of the sliding transparent pane into the sliding pane receiving channels of those plastic glide channel strips into which the longitudinal edges of the fixed pane have been inserted; inserting the plastic glide channel strips onto the delineating wall of the frame spline channel of longitudinally extending metal frame stiles and a top transversely extending metal frame rail of a rectangular metal door frame; and anchoring the push bar to the longitudinal stiles and to those plastic glide channel strips secured thereto.

The plastic glide channel strips employed in the method of the invention each have side-by-side fixed pane receiving channels and sliding pane receiving channels. The fixed, transparent rectangular pane has transverse top and bottom edges and opposing longitudinal edges. The plastic glide channel strips are secured to the fixed pane by inserting the top edge and the longitudinal edges of the fixed pane into the fixed pane receiving channels of the plastic glide channel strips. The sliding, transparent pane also has a pair of opposing transverse top and bottom edges and a pair of opposing longitudinal edges. The plastic glide channel strips are inserted onto the delineating wall of the frame spline channel so that the plastic glide channel strips grip the delineating wall and adhere thereto. This secures the plastic glide channel strips to the stiles and to the top rail of the metal door frame.

In the preferred practice of the invention, certain additional steps are performed prior to inserting the plastic glide channel strips onto the delineating walls of the metal frame.

Preferably the metal frame stiles and the top rail and bottom rail are all formed from a single strip of sheet metal stock by roll forming. The sheet metal strip is passed through rollers which form the stiles and rails, which are then bent at the transitions between these elements to thereby form the metal door frame as a unitary, enclosed rectangular structure. The transverse top and bottom rails are joined to the longitudinal stiles at opposing ends thereof.

In the preferred practice of the method of the invention a kick plate is also installed on the metal door frame. The kick plate is secured to the bottom rail and to the longitudinal stiles. A plastic bottom pane support is secured to a transverse edge of the kick plate remote from the bottom rail. Also, a channel-shaped pane protector is preferably installed on the top edge of the sliding pane.

Preferably also, in the preferred practice of the method, the delineating wall is configured with an overhanging bearing ledge that faces downwardly into the frame spline channel. The glide channels strips are configured with mounting arms having barbs at their extremities. The plastic glide channel strips are thereby inserted onto the delineating wall by hooking the mounting arms over the delineating wall so that the barbs thereon engage the bearing ledge. As a result, the plastic glide channel strips are securely anchored onto the delineating wall.

In the practice of the invention, the fixed and sliding glass panes may be connected to the plastic components of the storm door assembly in about two minutes time. The construction of a roll formed storm door frame takes only slightly more than ten seconds time. The assembly of the kick plate and the bottom pane support onto the metal storm door frame requires only about twenty seconds. As a consequence, an entire storm door constructed according to the invention and employing the method of the invention may be formed and assembled with less than eight minutes total direct labor. The fabrication of the storm door of the invention is thereby performed far more quickly, and therefore much more economically, than has heretofore been possible in the production of conventional storm doors.

The invention may be described with greater clarity and particularity by reference to the accompanying drawings.

DESCRIPTION OF THE EMBODIMENT AND IMPLEMENTATION OF THE METHOD

Figure 1:
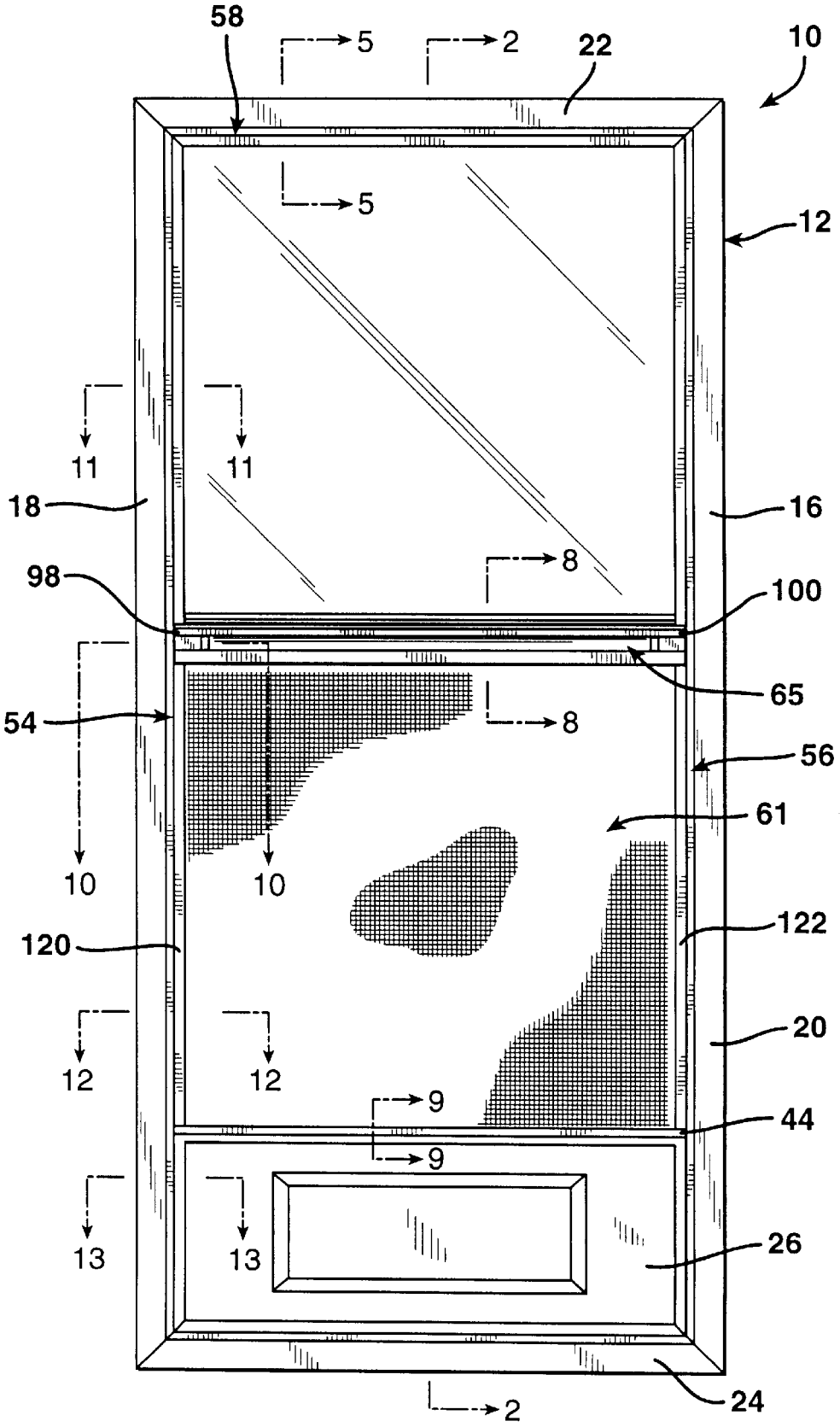
FIG. 1 is a front elevational view of a storm door constructed according to the invention.

FIG. 1 illustrates a storm door 10 constructed according to the invention. The storm door 10 is formed of a hollow, roll formed metal door frame 12 having an inside surface 14 and outside surface 16 opposite each other. The metal door frame 12 has a pair of opposing, elongated, hollow, tubular stiles 18 and 20 and opposing, hollow, tubular transverse top and bottom rails 22 and 24, respectively. The transverse top and bottom rails 22 and 24 are joined to the longitudinal stiles 18 and 20 at their opposing ends to form a rectangular enclosure.

The metal frame stiles 18 and 20 and the top rail 22 and bottom rail 24 are formed from a single strip of sheet metal stock by roll forming the sheet metal strip and bending it to thereby form the metal door frame 12 as a unitary, closed, rectangular structure. The fabrication of the metal door frame 12 is depicted and described in U.S. Pat. No. 5,628,114, which is incorporated herein in its entirety by reference.

Figure 16:
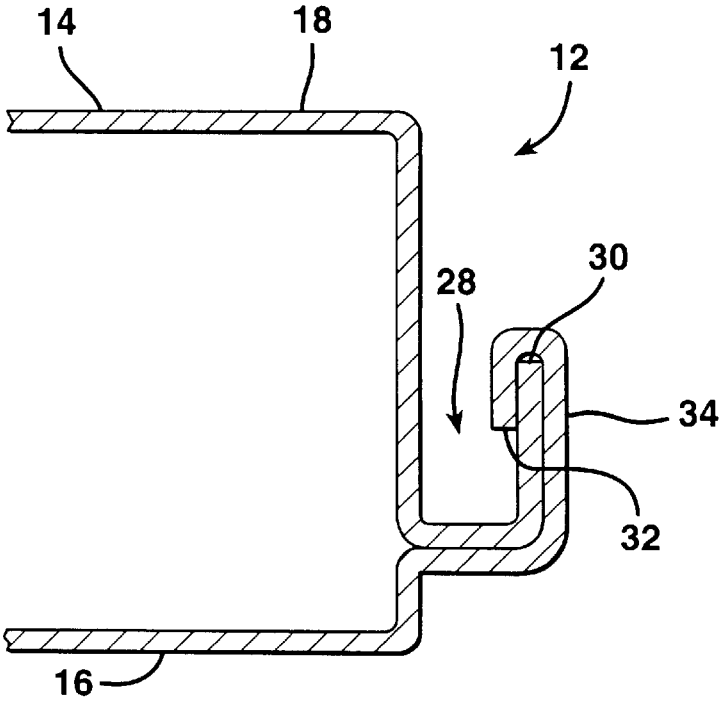
FIG. 16 is an enlarged sectional detail showing the frame spline channel formed in the storm door frame.

The stiles 18 and 20 are typically about eighty-four inches in length, and the rails 22 and 24 are typically formed in lengths of thirty, thirty-two, or thirty-six inches. As configured, the stiles 18 and 20 and the rails 22 and 24 of the metal door frame 12 are all formed with a U-shaped frame spline channel 28, which is visible in the cross-sectional detail view of FIG. 16. The frame spline channel 28 is formed by roll forming the edges 30 and 32 of the metal strip utilized to form the frame 12 together, and deforming the edges into the configuration depicted in FIG. 16.

Specifically, the marginal regions of the metal strip are bent outwardly away from the hollow body, and upwardly toward the front surface 16 of the metal frame structure 12. The edge 32 of the metal strip forming the frame 12 is wrapped over the edge 30 so that the margin of the metal strip immediately adjacent to the edge 32 extends back toward the floor of the frame spline channel 28. The transverse face of the metal edge 32 thereby forms a bearing ledge that faces downwardly toward the floor of the frame spline channel 28.

Subsequent to its manufacture, the metal door frame 12 is provided with a metal kick plate 26. The kick plate 26 is a sheet metal structure that is substantially flat in its interior region. The height of the kick plate 26 is about sixteen inches. The sheet metal kick plate 26 spans a distance slightly less than the thirty, thirty-two, or thirty-six inch width of the door frame 12 and has laterally projecting marginal end tabs or flanges 36 that pass over the top of the delineating wall 34 at the longitudinal stiles 18 and 20. The kick plate 26 also has a lower lip that extends down into the frame spline channel 28 of the bottom rail 24 and a transversely extending, U-shaped lip 38 at its top edge, which is visible in FIG. 9.

To install the kick plate 26 on the door frame 12, the lower lip along the lower edge of the kick plate 26 is inserted into the frame spline channel 28 at the bottom rail 24 while the end flanges 34 of the kick plate 26 are positioned to extend a short distance out over the frame spline channel 28 at the stiles 18 and 20 beyond the delineating wall 34.

Figure 13:
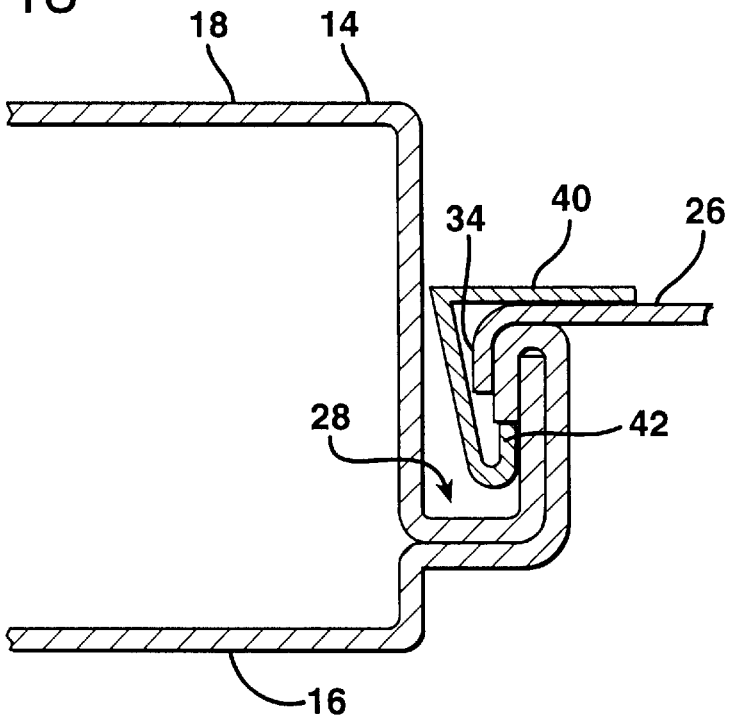
FIG. 13 is a sectional detail taken along the lines 13—13 of FIG. 1.

Left and right metal retaining beads 40, about sixteen inches in length, are positioned over the flanges 38 and above the portions of the frame spline channel 28 therebeneath. The metal retaining beads 40 are then forced into the frame spline channel 28 with hammer blows, thereby turning the end flanges 34 of the kick plate 26 over the top edges of the delineating wall 34, as illustrated in FIG. 13. Also, as illustrated in that same drawing figure, the lowest ends 42 of the retaining beads 40 are flexible enough to clear the flanges 34 of the kick plate 26 as they deform them, and spring back to lodge beneath the bearing ledge formed by the metal edge 32 on the inside of the delineating wall 34. The kick plate 26 is thereby firmly secured in place adjacent the bottom rail 24 of the door frame 12.

Once all of the metal parts of the door frame 12 have been assembled together, a plastic, bottom pane support 44 is attached to the lip 38 at the top of the kick plate 26. The configuration of the bottom pane support 44 is illustrated in the detail view of FIG. 9. Specifically, the bottom pane support 44 is formed to generally surround the lip 38 on its convex side. The bottom pane support 44 has a mounting flange 46 with a catch formed at its tip that engages the turned over edge of the lip 38 of the kick plate 26. The flat upper surface 48 of the bottom pane support 44 forms a screen frame seat while the raised rib 50 adjacent thereto forms a positioning seat for the sliding glass pane.

Within the confines of the sliding door frame 12 the storm door 10 has plastic glide channel strips 54 and 56, respectively secured to the door stiles 18 and 20, and another plastic glide channel strip 58 that is secured to the top rail 22. The storm door 10 has an upper, fixed, transparent rectangular glass pane 60 and a lower, sliding, transparent glass pane 63. The two glass panes 60 and 63 are approximately equal in size.

Beneath the fixed glass pane 60 there is a push bar 65 that is secured at its ends to the door stiles 18 and 20. A rectangular screen 61 is located between the push bar 65 and the bottom pane support 44 and is laterally embraced within the confines of the hollow, tubular portions of the door stiles 18 and 20. A channel-shaped glass protector 67 is secured along the top edge of the sliding glass pane 63 while a transversely extending sash member 69 is secured to the bottom edge of the sliding glass pane 63.

Figure 5:
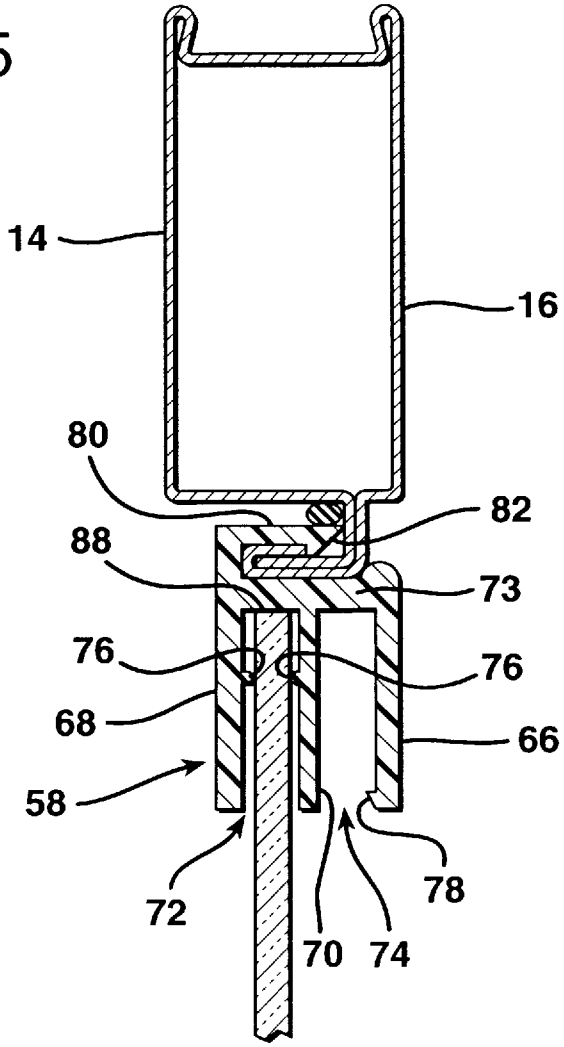
FIG. 5 is a sectional detail taken along the lines 5—5 of FIG. 1.
Figure 11:
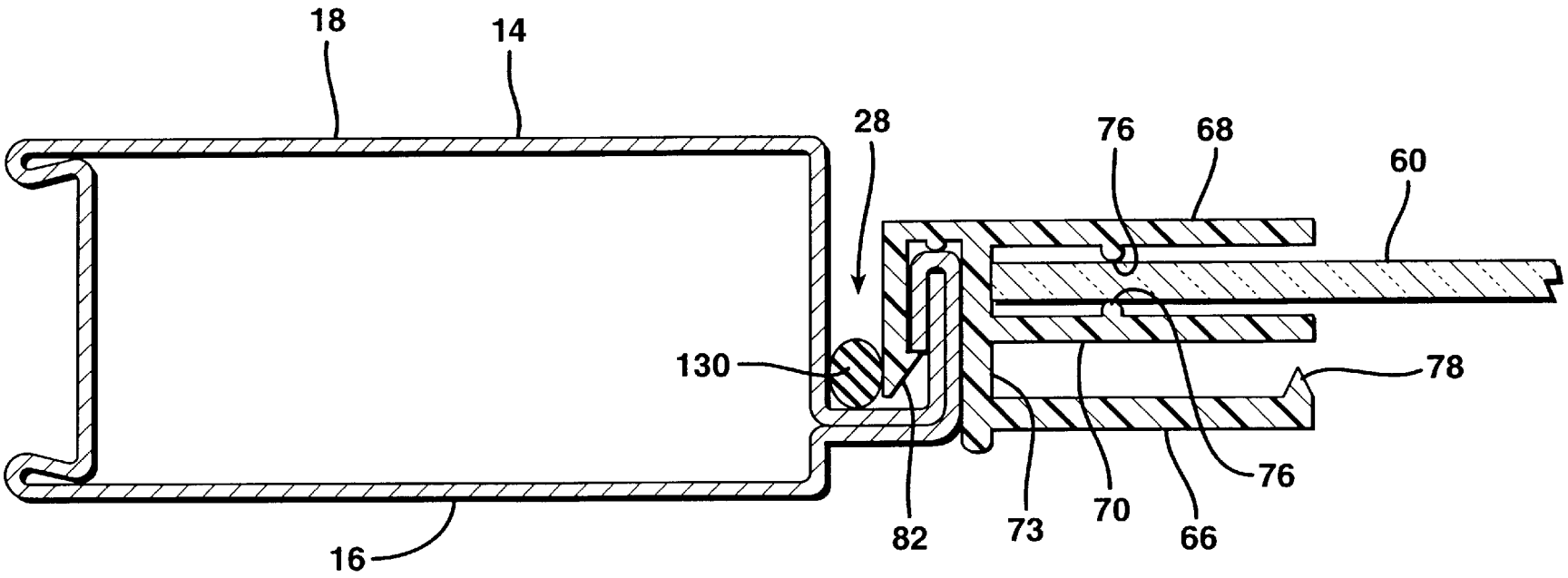
FIG. 11 is a sectional detail taken along the lines 11—11 of FIG. 1.
Figure 12:
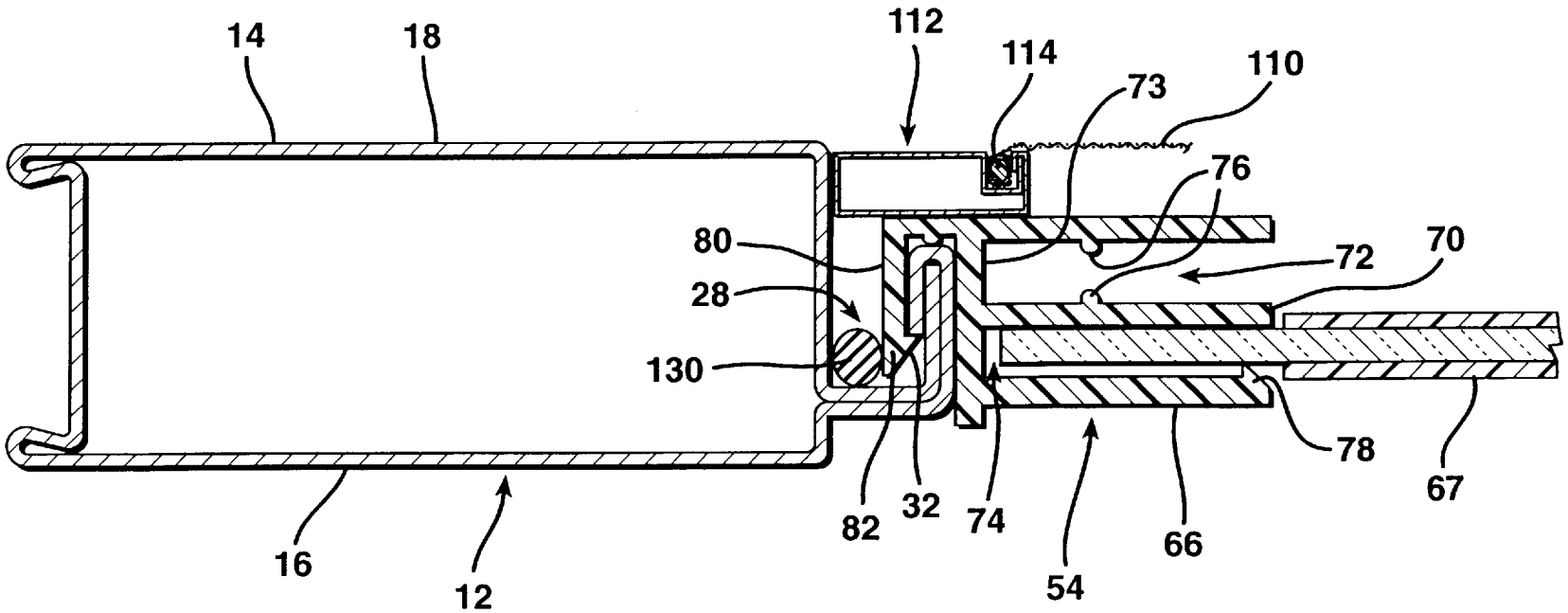
FIG. 12 is a sectional detail taken along the lines 12—12 of FIG. 1.
Figure 14:
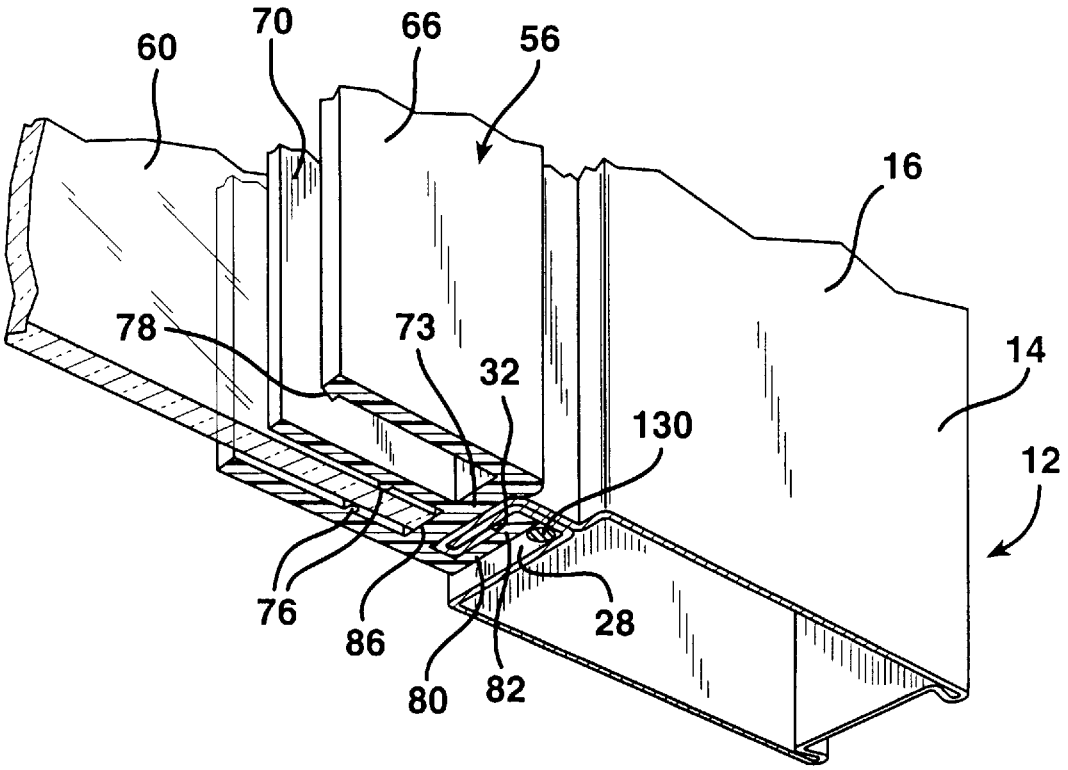
FIG. 14 is a cut away perspective view showing the fixed glass pane in one plastic glide channel on one of the stiles of the storm door frame.

The plastic glide channel strips 54 and 56 that are secured to the stiles 18 and 20, respectively, and the plastic glide channel strip 58 that is secured to the top rail 22 are all of the same cross-sectional configuration. FIG. 5 illustrates the top rail 22 and the plastic glide channel strip 58 secured thereto in cross-section, while FIGS. 11, 12, and 14 illustrate the cross-sectional configuration of the stile 18 and the plastic glide channel strip 54 secured thereto.

As illustrated in all of those drawing figures, each plastic glide channel strip is formed with a longitudinally extending inner wall 66, a longitudinally extending outer wall 68, and an intermediate wall 70, all projecting inwardly toward the rectangular area enclosed within the storm door frame 12 and substantially parallel to the inner and outer surfaces 14 and 16 thereof. Each of the walls 66, 68, and 70 is approximately one-sixteenth of an inch in thickness. The walls 66, 68, and 70 project inwardly from a common spine 73 a distance of about nine-sixteenths of an inch. together the glide channel strip walls 66, 68, and 70 form an outer, fixed pane receiving channel 72 located closest to the outside frame surface 14 of the storm door frame 12 and an inner, sliding pane receiving channel 74 located closest to the inside frame surface 16. The intermediate wall 70 serves as a common wall shared by the pane receiving channels 72 and 74.

The fixed pane receiving channels 72 of the plastic glide strips 54, 56, and 58 are each provided with pairs of mutually opposing, resilient, raised ribs 76 that extend the lengths of the fixed pane receiving channels 72. The pairs of mutually facing, raised ribs are located approximately three-eighths of an inch from the channel floors and are provided for performing moisture-tight seals against the fixed pane 60.

Figure 2:
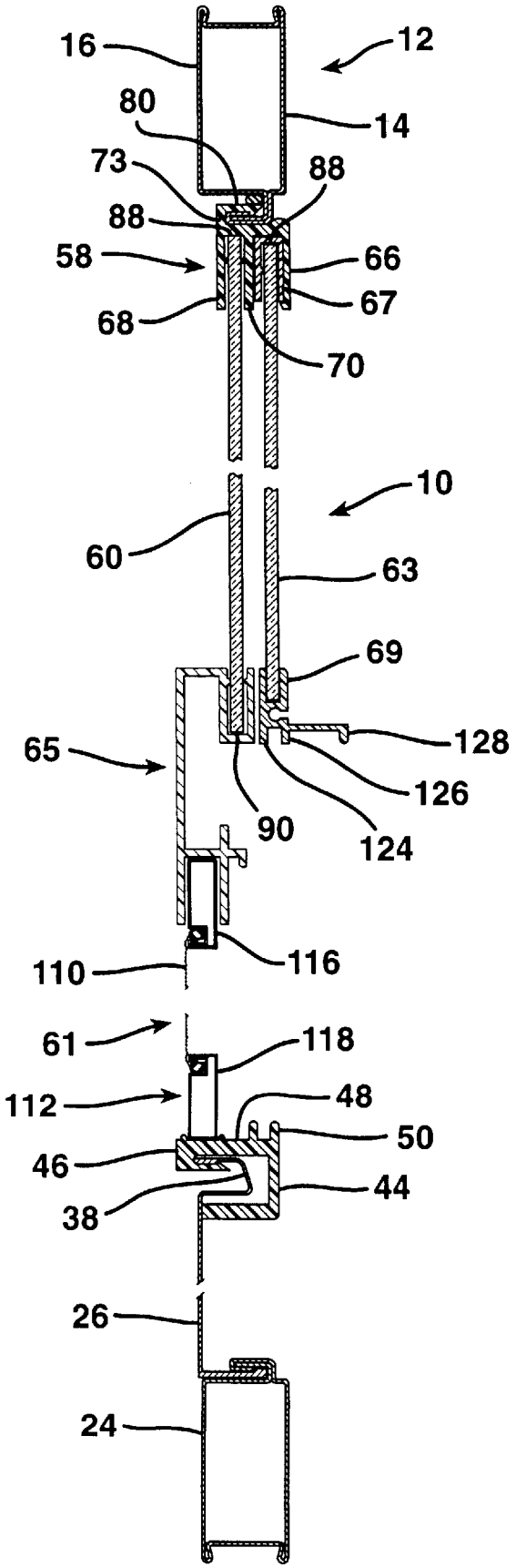
FIG. 2 is a sectional elevational view taken along the lines 2—2 of FIG. 1 showing the sliding transparent glass pane in its raised position.
Figure 3:
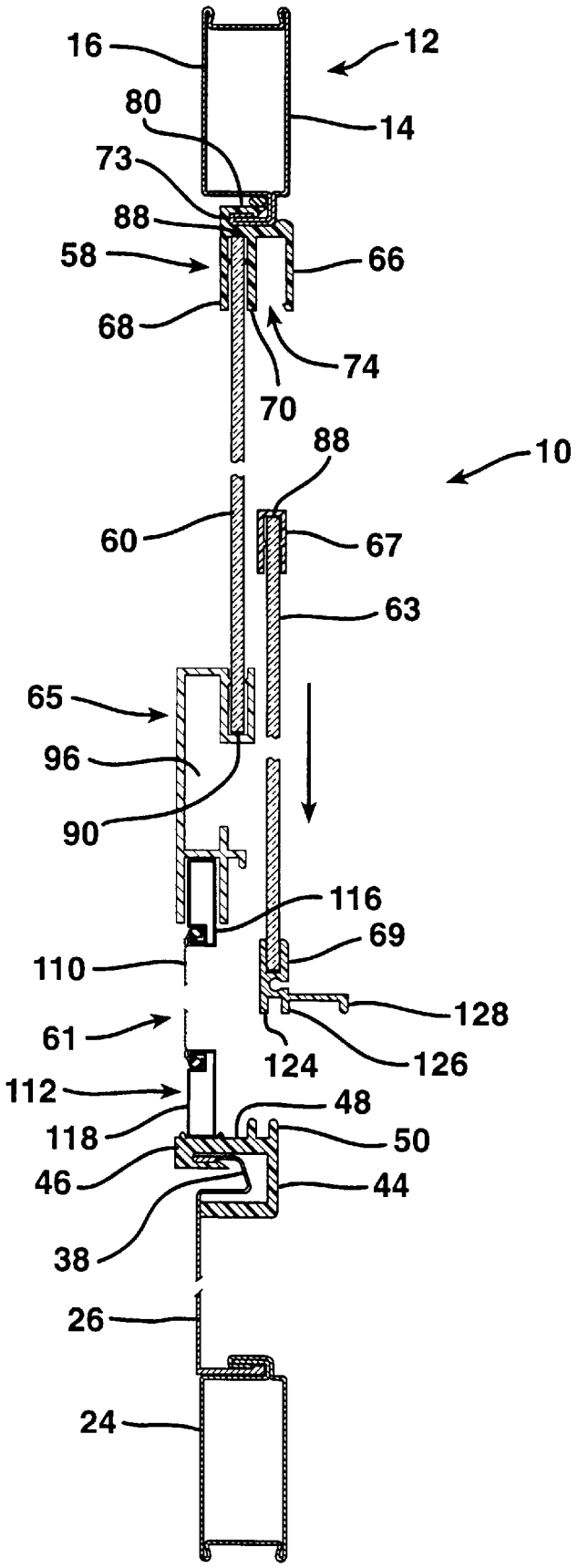
FIG. 3 is a sectional elevational view corresponding to that of FIG. 2 but showing the sliding glass pane in an intermediate position.

At the distal edges of each of the interior glide strip channel walls 66 there is an outwardly directed catch 78 that is provided to serve as a detent for capturing the top edge protector 67 of the sliding glass pane 63 when the sliding glass pane 63 is in the raised position depicted in FIG. 2. The channel-shaped plastic edge protector 67 that is secured to extend transversely across the top transverse edge of the sliding pane 63 is also provided with a pair of mutually opposing, resilient, raised ribs 76 that extend the length of the plastic edge protector 63 to form a moisture-tight seal against the sliding pane 63.

The plastic glide channel strips 54, 56, and 58 are also each provided with a mounting arm 80. The mounting arm 80 extends from the glide channel spine 73 in an opposite direction from the walls 66, 68, and 70 forming the pane receiving channels 72 and 74. Each mounting arm 80 is provided at its extremity with a barb 82 that engages and interlocks with the bearing ledge of the edge 32 formed on the delineating wall 34. The mounting arms 80 of the plastic glide channel strips 54, 56, and 58 thereby serve to grip the delineating wall 34.

The fixed, transparent, rectangular pane 60 has a pair of longitudinal edges 86 and a pair of transverse edges 88 and 90, respectively. The fixed pane 60 is disposed with its longitudinal edges 86 in the fixed pane receiving channels 72 of the glide channel strips 54 and 56 on the stiles 18 and 20. One of the transverse edges, specifically the upper transverse edge 88 of the fixed pane 60, is disposed in the fixed pane receiving channel 72 of the glide channel strip 58 that is secured to the top rail 22 of the metal door frame 12.

The transverse push bar 65 is located approximately midway between the top rail 22 of the door frame 12 and the lip 38 of the kick plate 26. The transverse push bar 65 defines in its top or upper side an upwardly facing, channel-shaped, fixed pane receiving groove 92 and on its opposing, lower side a downwardly facing, channelshaped screen receiving groove 94. The upwardly facing groove 92 is provided with a pair of mutually opposing, resilient, raised ribs 76 that extend the length of the groove 92. The ribs 76 form a moisture-tight seal against the fixed pane 60 near its bottom edge 90, as best depicted in FIG. 8.

Figure 8:
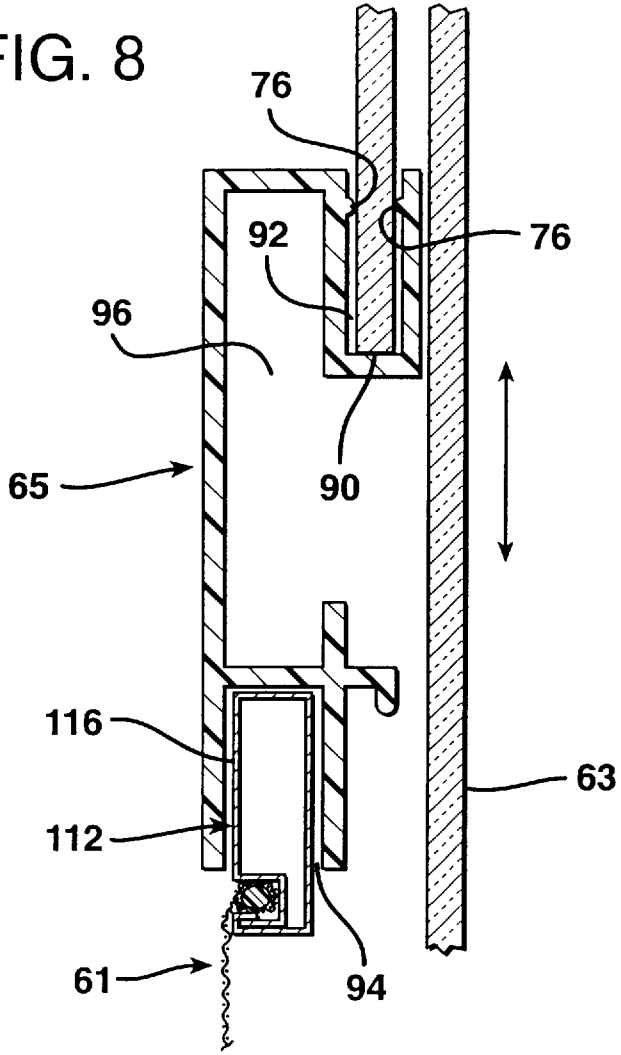
FIG. 8 is a sectional elevational detail taken along the lines 8—8 of FIG. 1.
Figure 15:
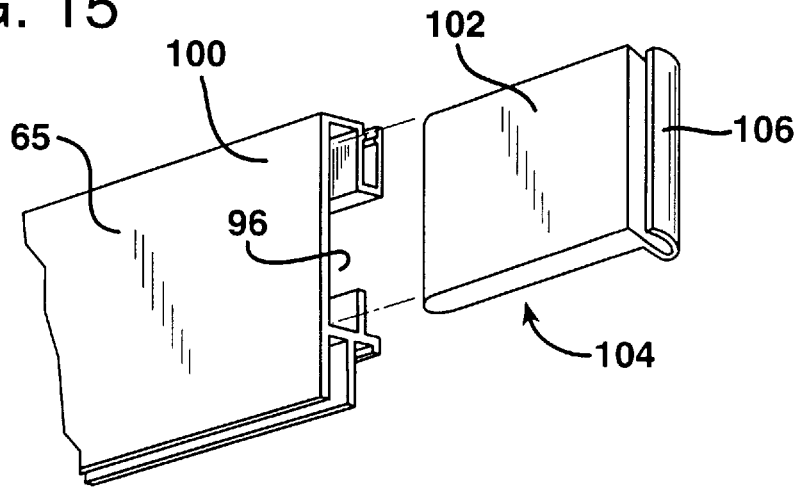
FIG. 15 is an exploded perspective view illustrating the coupling number employed with the push bar illustrated in FIGS. 8 and 10.

As illustrated in FIGS. 8 and 15, the push bar 65 is configured to form a generally C-shaped cavity 96. At the ends 98 and 100 of the push bar 65, the cavity 96 forms sockets that receive and snugly grip the bodies 102 of push bar retainers 104. The push bar retainers 104 are inserted into the opposite ends 98 and 100 of the push bar 65 and include resiliently compressible, generally U-shaped anchoring elements 106 that are forced into the frame spline channels 28 and which wedge the mounting arms 80 of the plastic glide channel strips 54 and 56 into intimate, secure engagement with the delineating wall 34 at the stiles 18 and 20 of the storm door frame 12.

Since the resilient, U-shaped, anchoring elements 106 of the push bar retainer 104 are resiliently compressed between the outer wall of the frame spline channel 28 and the mounting arms 80 of the glide channel strips 54 and 56, they ensure that the barbs 82 on the tips of the mounting arms 80 remain firmly in place in abutment against the bearing ledge formed by the sheet metal edge 32.

The screen 67 that is located beneath the push bar 65 is a conventional, rectangular screen in which wire or nylon screen mesh 110 is stretched across an aluminum or plastic frame 112 and held in place by a compressible rubber bead 114 in a conventional manner. The expanse of screen mesh 110 is bounded by the members forming the screen frame 112. The screen frame 112 is formed with a pair of transverse members, specifically the upper transverse member 116 and the lower transverse member 118, and a pair of longitudinal members 120 and 122, visible in FIG. 1. The upper and lower transverse members 116 and 118 are mutually perpendicular to the longitudinal members 120 and 122.

Figure 9:
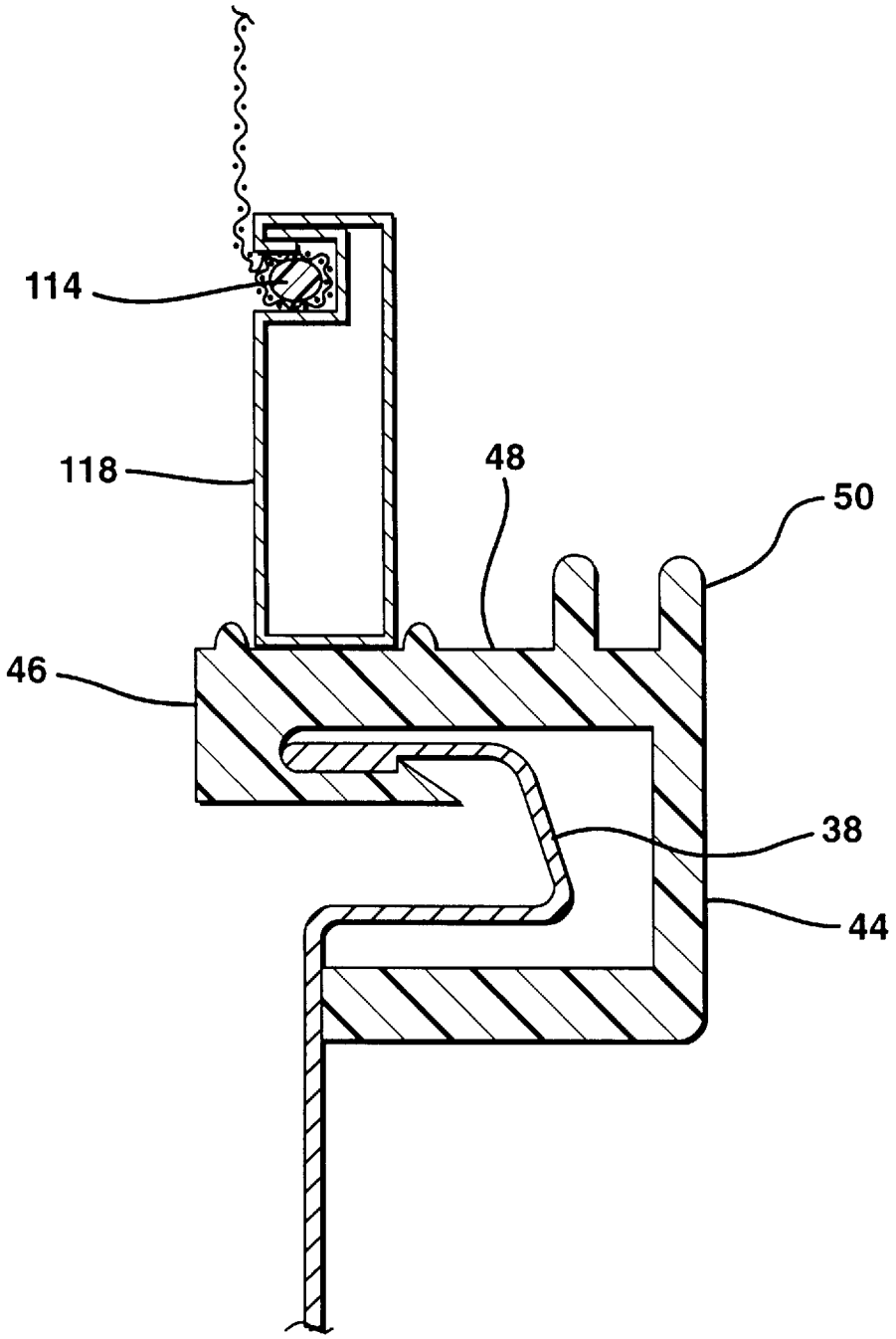
FIG. 9 is a sectional elevational detail taken along the lines 9—9 of FIG. 1.
Figure 10:
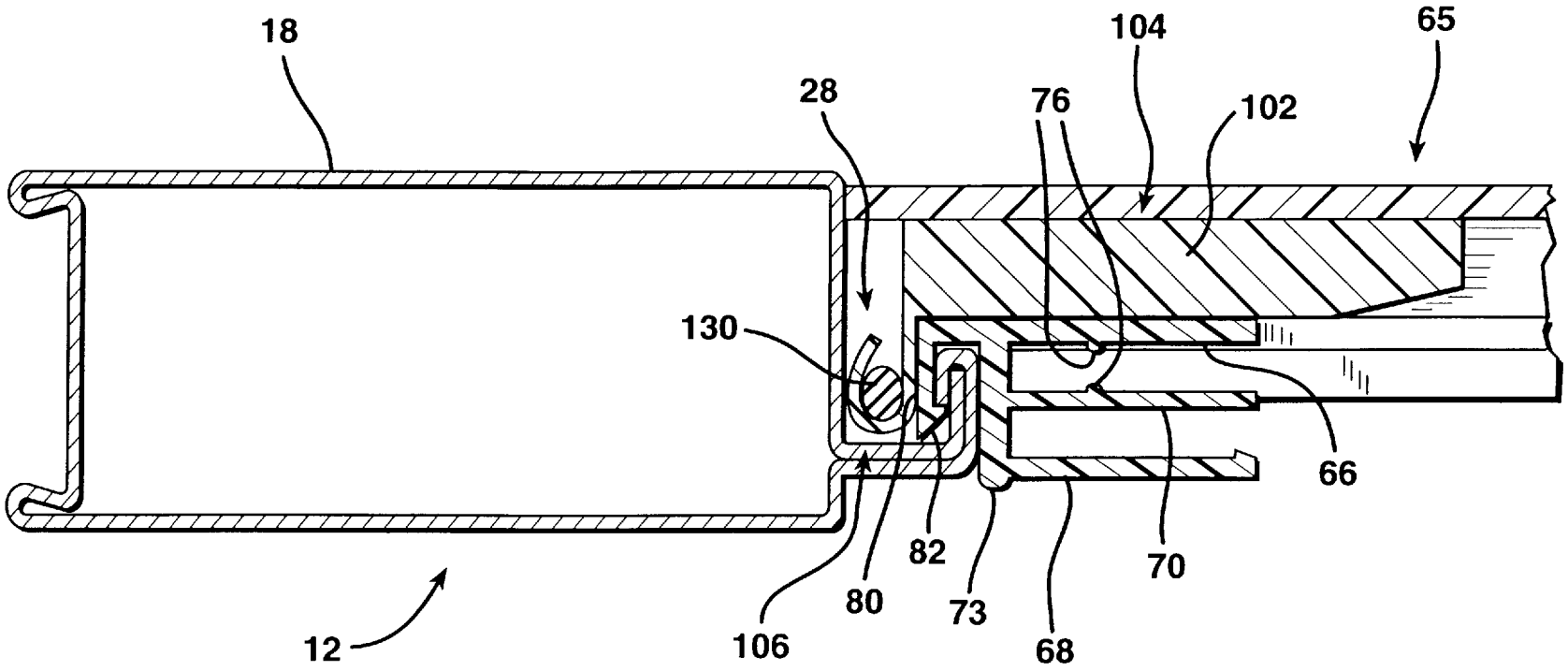
FIG. 10 is a sectional detail taken along the lines 10—10 of FIG. 1.

The upper transverse screen frame member 116 is seated in the screen receiving groove 94 of the push bar 65. The longitudinal pair of screen frame members 120 and 122 are embraced within the stiles 18 and 20 just in front of the delineating wall 34 thereof. The lower transverse screen frame member 118 is seated atop the horizontal surface 48 of the bottom pane support 44 as depicted in FIG. 9.

Figure 7:
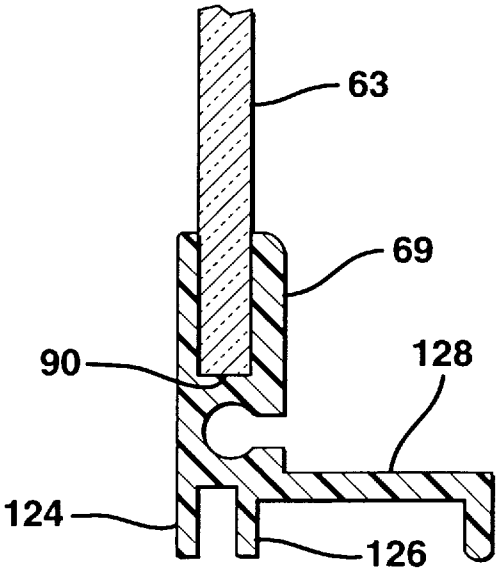
FIG. 7 is an enlarged sectional detail illustrating the plastic sash at the bottom edge of the sliding glass pane.

The sliding, transparent, rectangular pane 63 has a pair of longitudinal edges 86, a top edge 88, and a bottom edge 90, the same as the fixed pane 60. The sliding pane 63 is disposed so that its longitudinal edges 86 reside in sliding engagement in the sliding pane receiving channels 74 of the plastic glide channel strips 54 and 56 that are secured to the stiles 18 and 20. The plastic, inverted channel-shaped top edge protector 67 is sufficiently resilient to firmly grip the top edge 88 of the sliding pane 63. Similarly, the plastic sash member 69 has an upwardly facing channel therein that receives the lower edge 90 of the sliding pane 63, as depicted in FIG. 7.

At its lower extremity the plastic sash member 69 has a pair of short, downwardly projecting seating lips 124 and 126 that are spaced apart a short distance to snugly receive the upwardly projecting rib 50 at the top of the bottom pane support 44. The sash member 69 also has a laterally inwardly projecting flange 128 that forms a finger grip for a user to raise and lower the sliding pane 63.

When the storm door 10 is installed within the jamb space of a building opening, a user can raise and lower the sliding pane 63 at will. FIG. 2 depicts the sliding pane 63 raised to a position adjacent the fixed pane 60 and located toward the interior side 14 of the door frame 12. When the sliding pane 63 is raised as illustrated in FIG. 2, the area behind the screen 61 is unobstructed, thereby providing ventilation and allowing the flow of air through the lower portion of the storm door 10. When the sliding pane 63 is in the raised position of FIG. 2, the detent catch 78 on the interior channel wall 66 of the plastic glide strip 58 secured to the top rail 22 of the door frame 12 holds the sliding pane 63 in its raised position.

In colder weather it is advisable to lower the sliding pane 63 so as to block the opening behind the screen 61. To do this the user merely pulls downwardly on the finger grip formed by the flange 128 to overcome the detent engagement between the lower extremity of the top edge protector 67 at the top of the sliding pane 63 and the detent catch 78. The plastic structure of the wall 66 of the plastic glide strip 58 is resilient enough to allow a downward force on the finger grip flange 128 to dislodge the detent catch 78 from the top edge protector 67. The sliding pane 63 proceeds in a controlled descent with the longitudinal edges 86 of the sliding pane 63 progressing downwardly within the sliding pane receiving channels 74 of the plastic glide channel strips 54 and 56 that are secured to the stiles 18 and 20.

Figure 4:
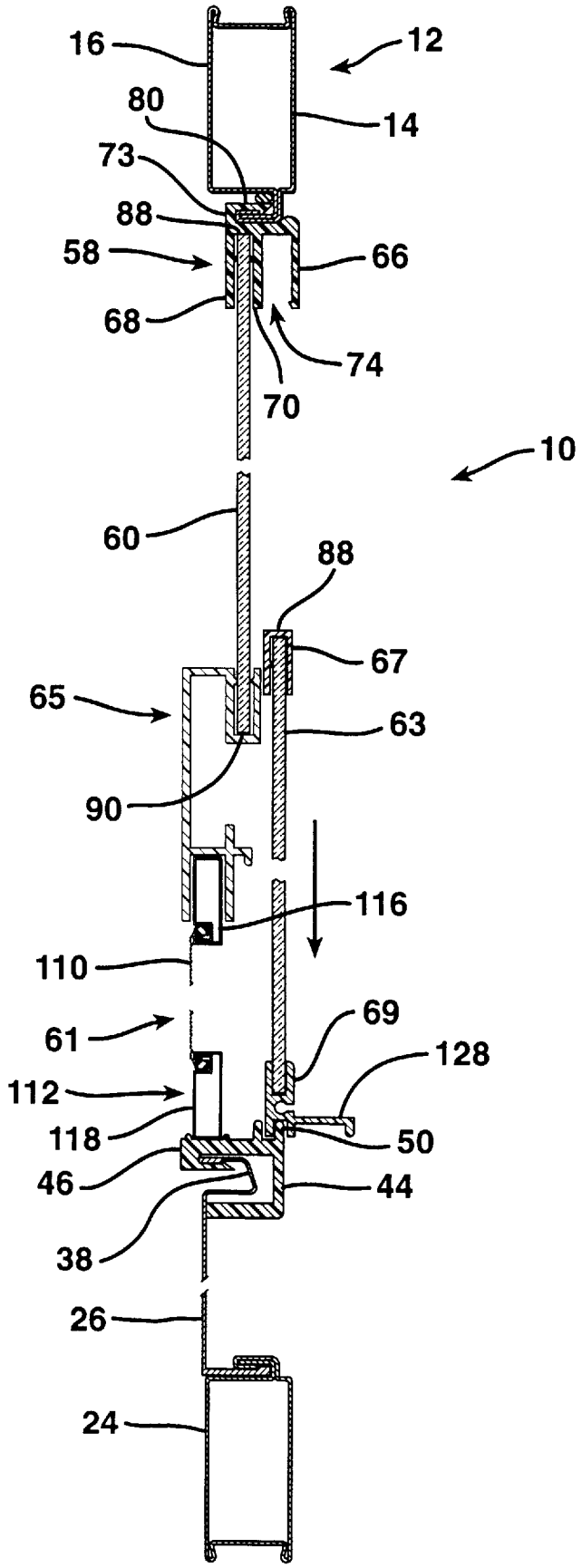
FIG. 4 is a sectional elevational view corresponding to that of FIG. 2 but showing the sliding glass pane in a lowered position.
Figure 6:
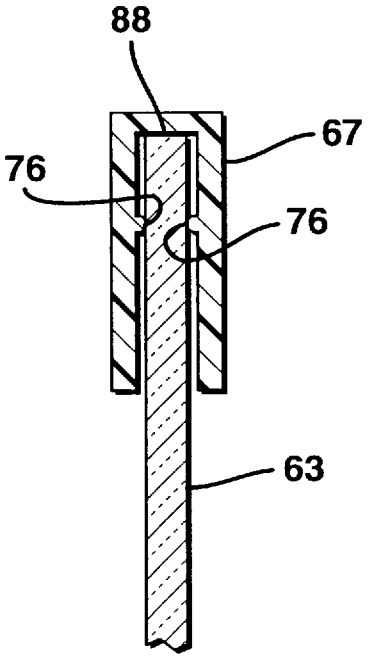
FIG. 6 is an enlarged sectional detail showing the edge protector at the top edge of the sliding glass pane.

As the sliding pane 63 reaches the bottom of its descent, the seating lips 124 and 126 embrace and pass on either side of the upwardly projecting rib 50 at the top of the bottom glass support 44, as illustrated in FIG. 4. With the sliding pane 63 in the lowered position depicted in FIG. 4, the seated arrangement of the sealing lips 124 and 126 relative to the rib 50 provide a moisture seal at the bottom of the sliding pane 63. When the sliding pane 63 is in this position, the outwardly facing surface of the top edge protector 67 resides in contact with the inside surface of the inner portion of the push bar 65 that forms the upwardly facing groove 92 to prevent air currents from flowing therebetween. With the sliding pane 63 in the lowered position of FIG. 4, the storm door 10 provides both a thermal and moisture barrier between its outside surface 16 and its inside surface 14.

The structure of the storm door 10 may be built very rapidly and very easily. The steps in creating and assembling the metal door frame 12, the kick plate 26, and the bottom glass support 44 have previously been described. The remaining assembly steps are carrier out in the following manner.

The plastic glide channel strips 54, 56, and 58, the push bar 65, the push bar retainers 104, the top edge protector 67, and the sash member 69 are all produced as extruded plastic members. The glide channel strips 54, 56, and 58 may all be cut to length from the same extruded plastic stock and mitered at their mutually intersecting ends. The plastic glide channel strip 58 is attached to the top edge 88 of the fixed pane 60 by inserting the top edge 88 of the fixed pane 60 into the fixed pane receiving channel 72 of the glide channel strip 58. The ribs 76 in the channel 72 serve to grip the upper peripheral margin of the fixed pane 60 near the top edge 88 thereof so as to hold the plastic glide channel strip 58 in position.

The longitudinal edges 86 of the fixed pane 60 are similarly inserted into the fixed pane receiving channels 72 of the longer glide channel strips 54 and 56 in the upper portions thereof. The glide channel strips 54 and 56 likewise firmly grip the longitudinal margins of the fixed pane 60 near the longitudinal edges 86 thereof due to the contact between the glass of the fixed pane 60 and the ribs 76 in the fixed pane receiving channels 72 of the glide channel strips 54 and 56. The push bar 65 is next attached to the fixed pane 60 by pressing the lower edge 90 of the fixed pane 60 into the upwardly facing groove 92 of the push bar 65.

The top edge protector 67 is then inserted onto the top edge 88 of the sliding pane 63. The plastic sash member 69 is attached to the bottom transverse edge 90 of the sliding pane 63 by inserting the bottom edge 90 of the pane 63 into the channel formed in the sash 69. The top edge protector 67 and the sash member 69 are both of a length no greater than the distance between the glide channel strips 54 and 56. The longitudinal edges 86 of the sliding pane 63 are then inserted into the sliding pane receiving channels 74 of the glide channel strips 54 and 56 at the ends thereof opposite the glide channel strip 58. The sliding pane 63 is thereupon moved toward the glide channel strip 58 until the detent catch 78 of the glide channel strip 58 engages the lower inside extremity of the top edge protector 67 that is attached to the sliding pane 63.

The top frame member 116 of the frame 112 of the screen 61 is next inserted into the downwardly facing groove 94 of the push bar 65. The bodies 102 of the push bar retainers 104 are pressed into the sockets formed by the ends of the C-shaped cavity 96. The entire assembly so produced is then moved into proximity to the storm door frame 12 so that the mounting arms 80 of the glide channel strips 54, 56, and 58 are directed downwardly into the frame spline channels 28 of the stiles 18 and 20 and top rail 22, respectively, of the frame 12. The mounting arms 80 are then pressed downwardly into the frame spline channels 28 until their distal edges bearing the barbs 82 clear the bearing ledges 32 on the inside surfaces of the delineating wall 34. The mounting arms 80 are resiliently deflected as they pass downwardly, so that once the barbs 82 clear the bearing ledges 32 they snap back into position into abutting relationship therewith.

Once the barbs 82 are engaged with the bearing ledge 32 throughout the entire lengths of the glide channel strips 54, 56, and 58, the resiliently compressible elements 106 of the push bar retainers 104 are forced down into the frame spline channels 28 between the mounting arms 80 of the glide channel strips 54, 56, and 58 and the hollow, tubular structure of the stiles 18 and 20 and the top rail 22. The resiliently compressible elements 106 of the push bar retainers 104 thereby securely lock the barbs 82 beneath the bearing ledges 32 at the centers of the stiles 18 and 20. A resilient, elongated spline 130 is then forced into the channel 28 throughout the lengths of the stiles 18 and 20 and the top rail 22 both to provide a seal and to force the barbs 82 into engagement with the bearing ledge 32 throughout the lengths of glide channel strips 54, 56, and 58. The completed storm door 10 is then ready for use in the customary manner. If the glide channel strips 54, 56, or 58 or the glass panes 60 or 63 ever require replacement, the spline 130 is simply removed to allow barbs 82 to retract, thus freeing the glide channel strips 54, 56, and 58 from the channel 28.

Undoubtedly, numerous variations and modifications of the invention will become readily apparent to those of ordinary sill in the art. For example, while the use of glass for the transparent panes 60 and 63 is preferred, a transparent plastic could be substituted instead. Also, while the particular mounting arm configuration employing barbs that reside beneath overhanging bearing ledges is envisioned as the preferred manner of interconnecting the plastic glide channel strips to the storm door frame, other interconnection techniques are also possible. Accordingly, the scope of the invention should not be construed as limited to the specific embodiment of the structure and implementation of the method described.

I claim:

1. A storm door comprising:

a rectangular metal door frame formed with interior and exterior faces, a pair of longitudinally extending stiles and top and bottom rails extending between and joining said stiles, wherein said stiles and rails define an enclosed rectangular area and a frame spline channel having a channel floor from which a delineating wall rises to surround said enclosed rectangular area, and said delineating wall is created with a bearing ledge, plastic glide channel strips on each of said stiles and on at least one of said rails, said glide channel strips each being formed as a unitary structure having three inwardly directed legs forming an exterior pane receiving channel and an adjacent interior pane receiving channel and having a mounting arm hooked over said delineating wall and said mounting arms of said plastic glide channel strips are formed with resiliently deflectable barbs that grip said bearing ledge in sealing engagement therewith when said mounting arms are hooked over said delineating wall to thereby secure said mounting arms thereto, a fixed, transparent, rectangular pane having four edges and disposed in said exterior pane receiving channels in direct contact with said plastic glide channel strips with three edges of said fixed pane seated between said stiles and one of said rails to establish moisture-tight seals therewith, a transverse push bar having opposing upper and lower sides and having ends secured to said stiles, and defining on one of its upper and lower sides a fixed pane receiving groove lying in coplanar relationship with said exterior pane receiving channels in said glide channel strips for receiving an edge of said fixed rectangular pane and defining on the other of its upper and lower sides a screen receiving groove, a window screen located within said metal door frame and having two longitudinal screen frame edges and two opposing transverse screen frame edges, wherein said longitudinal screen frame edges are seated between said metal frame stiles in said glide channel strips and one of said transverse screen frame edges is seated in said screen receiving groove of said push bar, a sliding, transparent, rectangular pane having opposing transverse edges and opposing longitudinal edges wherein its longitudinal edges are disposed in said interior pane receiving channels of said glide channel strips, and a sash member secured to one of said transverse edges of said sliding pane and having an interiorly projecting finger grip thereon.

2. A storm door according to claim 1 further comprising a kick plate secured to said frame spline channel at said stiles and at said bottom rail, and wherein said upper edge of said kick plate forms a transversely extending lip, and further comprising a plastic bottom support for said sliding pane attached to said lip of said kick plate, wherein said sash member is moveable into abutting contact against said bottom support for said sliding pane.

3. A storm door according to claim 1 further comprising a plastic channel-shaped edge protector secured to the other of said transverse edges of said sliding pane.

4. A storm door according to claim 3 wherein each of said pane receiving channels of said glide channel strips and said channel shaped edge protector is formed with opposing, mutually facing, raised ribs that extend the lengths of said pane receiving channels and said edge protector and contact said transparent panes.

5. A storm door according to claim 1 wherein said ends of said transverse push bar form sockets and further comprising coupling elements located at said ends of said transverse push bar, wherein said coupling elements are received in said sockets of said push bar and said coupling elements are formed with retaining elements residing in said frame spline channel and resiliently compressed between said stiles and said mounting arms of said plastic glide channel strips secured to said stiles.

6. A storm door according to claim 1 wherein one of said three edges of said fixed pane is an upper edge which is received in said exterior pane receiving channel of said top rail.

7. A storm door comprising:

a hollow metal door frame having opposite inside and outside surfaces and opposing longitudinal stiles and opposing, transverse, top and bottom rails joined at their ends to form a rectangular enclosure, said stiles and said rails forming a frame spline channel with a delineating wall directed toward said outside surface of said frame and bounding said rectangular opening, plastic glide channel strips secured to said delineating wall on both of said stiles and to said delineating wall on at least one of said rails, each of said plastic glide channel strips being formed as a unitary structure and forming a fixed pane receiving channel located closest to said outside frame surface and directed toward said rectangular enclosure and a sliding pane receiving channel sharing a common wall with said fixed pane receiving channel and located closest to said inside frame surface, and wherein said plastic glide channel strips are each provided with an anchoring arm extending in a direction opposite to that of said pane receiving channels, and said anchoring arms are resilient and grip both of said stiles and said at least one of said rails in sealing engagement therewith, a fixed, transparent rectangular pane having a pair of longitudinal edges and a pair of transverse edges and disposed with its longitudinal edges in said fixed pane receiving channels of said glide channel strips on said stiles and with one of said transverse edges in said fixed pane receiving channel of said glide channel strip on one of said rails, a traverse push bar extending between and secured to said stiles and having opposing upper and lower sides facing said rails, and defining in one of said opposing sides a fixed pane receiving groove in which the other of said transverse edges of said fixed pane is seated and defining on the other of said opposing sides a screen receiving groove, a rectangular screen formed with an expanse of screen mesh bounded by mutually perpendicular transverse and longitudinal pairs of opposing screen frame members, wherein one of said transverse screen frame members is seated in said screen receiving groove of said push bar and said longitudinal pair of screen frame members are embraced between said stiles of said frame, a sliding, transparent rectangular pane having a pair of longitudinal edges and a pair of transverse top and bottom edges disposed so that its longitudinal edges reside in sliding engagement is said sliding pane receiving channels of said plastic glide channel strips that are secured to said stiles, and a plastic sash member secured to one of said transverse edges of said sliding pane and having a finger grip thereon.

8. A storm door according to claim 7 wherein said plastic glide channel strip in which said one of said transverse edges of said fixed pane is received is secured to said top rail of said metal door frame, and further comprising a kick plate secured across said longitudinal rails and to said bottom rail of said metal door frame.

9. A storm door according to claim 7 wherein said delineating wall is created with a bearing ledge directed toward the bottom of said frame spline channel, and said anchoring arms are provided with barbs that engage and interlock with said bearing ledge of said delineating wall.

10. A storm door according to claim 8 further comprising a plastic bottom pane support secured transversely across said kick plate remote from said bottom rail to form a seat for said plastic sash member, and said transverse edge of said sliding pane to which said sash member is secured is said bottom transverse edge.

11. A storm door according to claim 9 further comprising push bar retainers located at the extremities of said push bar, and said push bar retainers include resilient compressible anchoring elements that are inserted into said frame spine channel and which wedge said anchoring arms of said plastic glide channel strips into intimate, secure engagement with said delineating wall.

12. A storm door according to claim 10 further comprising a channel-shaped, plastic edge protector secured to extend transversely across said top transverse edge of said sliding pane.

13. A storm door according to claim 12 wherein said fixed pane receiving channels of said plastic glide strips are each provided with pairs of mutually opposing, resilient, raised ribs extending the lengths of said fixed pane receiving channels for forming moisture tight seals against said panes.

14. A method of fabricating a storm door comprising:

configuring a plurality plastic glide channel strips, each as a unitary structure having side-by-side fixed pane receiving and sliding pane receiving channels sharing a common wall therebetween, and amounting arm having a barb at its extremity, securing said glide channel strips to a fixed, transparent rectangular pane having transverse top and bottom edges and opposing longitudinal edges by inserting said top edge and said longitudinal edges of said fixed pane into three of said fixed pane receiving channels of said plastic glide channel strips, inserting said bottom edge of said fixed pane into an upper transverse groove of a transverse push bar that also has a lower transverse groove, inserting a plastic sash member onto the bottom transverse edge of a sliding, transparent, rectangular pane having an opposing pair of transverse top and bottom edges and an opposing pair of longitudinal edges, inserting said longitudinal edges of said sliding, transparent rectangular pane into said sliding pane receiving channels of those plastic glide channel strips into which said longitudinal edges of said fixed pane have been inserted, configuring longitudinally extending metal frame sties and a top transversely extending metal door frame rail of a rectangular metal door frame with frame spline channels having delineating walls and bearing ledges, inserting said plastic glide channel strips onto said delineating walls of said frame spline channels of said longitudinally extending metal frame stiles and said top transversely extending metal frame rail of said rectangular metal door frame so that said mounting arms of said plastic glide channel strips deflect resiliently to engage said barbs thereof with said bearing ledges to thereby grip said delineating walls and adhere thereto in sealing engagement therewith, thereby securing said plastic glide channel strips to said stiles and to said top rail, and anchoring said push bar to said longitudinal stiles and to those plastic glide channel strips secured thereto.

15. A method according to claim 14 further comprising, prior to inserting said plastic glide channel strips onto said delineating wall:

forming said metal frame stiles and said top rail and a bottom rail from a single strip of sheet metal stock by roll forming said sheet metal strip and bending it to thereby form said metal door frame as a unitary, enclosed rectangular structure in which said transverse top and bottom rails are joined to said longitudinal stiles at opposing ends thereof, and installing a kick plate on said metal door frame so that said kick plate is secured to said bottom rail and to said longitudinal stiles, and securing a plastic bottom pane support to a transverse edge of said kick plate remote from said bottom rail.

16. A method according to claim 15 further comprising installing a channel-shaped pane protector onto said top edge of said sliding pane.

* * * * *